US005099804A

United States Patent [19]

Creeron

[11] Patent Number: 5,099,804

[45] Date of Patent: Mar. 31, 1992

[54] PRESSURE RELIEF DEVICE FOR COOLING SYSTEMS

[75] Inventor: Richard F. Creeron, Valley Stream, N.Y.

[73] Assignee: First Brands Corporation, Danbury, Conn.

[21] Appl. No.: 751,400

[22] Filed: Aug. 28, 1991

[51] Int. Cl.[5] ..... F01P 3/22

[52] U.S. Cl. ..... 123/41.54; 123/41.01; 137/318

[58] Field of Search ..... 123/41.15, 41.54, 41.01; 137/317, 318

[56] References Cited

U.S. PATENT DOCUMENTS

| | | | |
|---|---|---|---|
| 2,114,583 | 4/1938 | Adams | 137/318 |
| 3,162,211 | 12/1964 | Barusch | 137/318 |
| 3,343,724 | 9/1967 | Malpas | 137/318 |
| 3,509,905 | 5/1970 | Mullins | 137/318 |

*Primary Examiner*—Noah P. Kamen

*Attorney, Agent, or Firm*—Gary L. Wamer

[57] ABSTRACT

A pressure relief device for accessing a cooling system of an internal combustion engine under a pressure greater than ambient pressure whereby the pressure is reduced.

8 Claims, 1 Drawing Sheet

PRESSURE RELIEF DEVICE FOR COOLING SYSTEMS

BACKGROUND OF THE INVENTION

1. Field of the Invention

The present invention relates to a pressure relief device for the cooling system of an internal combustion engine under pressure. During the maintenance of internal combustion engines, it is common practice to desire access to the liquid in the cooling system while the cooling system is under pressure and while the liquid in the cooling system is hot. Such is the case in some processes for the change-over of used antifreeze/coolant in a cooling system to a new antifreeze/coolant when the charge-over process is to be carried out while the used antifreeze/coolant is at a sufficiently high temperature, e.g., 180° F. and higher, and the thermostat of the engine remains in an open position.

2. Description of the Prior Art

Review of the prior art has not revealed any apparatus directed to the relief of pressure in a cooling system of an internal combustion engine by means of a hose associated with the cooling system. It is well known in the prior art to provide pressure relief to a cooling system by use of a two-step radiator cap. Such a radiator cap is provided with an intermediate position between the closed position of the radiator cap and removal of the radiator cap whereat the cooling system is vented to ambient pressure so as to reduce the pressure of the cooling system. In practice a cloth or bag is placed over the radiator cap to prevent uncontrolled spraying of antifreeze/coolant as the cooling system is vented. Unfortunately, the undirected discharge of antifreeze/coolant at the radiator cap is undirected and provides a safety hazard as the hot antifreeze/coolant sprays from the radiator cap.

A review of the prior art was conducted in: Class 73, Subclasses 863, 863.11, 863.12, 863.81 and 863.85; Class 123, Subclass 41.55; Class 137, Subclasses 317 and 318; Class 141, Subclass 330; Class 184, Subclasses 1.5 and 105.1; and Class 222, Subclasses 81 and 82. The following patents were located by the search:

| U.S. Pat. No. | PATENTEE |
|---|---|
| 1,538,273 | Darrow |
| 1,806,363 | Narbo |
| 2,254,102 | Cruse |
| 3,762,432 | Peterson |
| 4,524,811 | Taylor |

U.S. Pat. No. 1,538,273 discloses a top for liquid containers of the type used for milk. The top comprises a conically shaped tube with a point to penetrate the wall of the container, a tab in tube for accessing the liquid in the container and a disk for contacting the container wall for maintaining the top in the correct position.

U.S. Pat. No. 1,806,363 discloses a dispensing device for a container comprising a hollow cylindrical member having one end pointed for perforating a wall to provide an outlet opening with a shoulder to limit insertion of the hollow cylindrical member into the container. A flexible conduit may be attached to one end of the hollow cylindrical member.

U.S. Pat. No. 2,254,102 discloses a device for connecting a hydrometer to the circulating cooling system of an internal combustion engine having a tube with one end for a hydrometer with the other end bevelled or otherwise sharpened to penetrate a hose connection between the engine and the radiator. A combination of a downwardly tapered boss and a nut on a thread portion of the tube assembly acts to hold the hydrometer in place after the boss penetrates the hose and the nut is tightened against the outer hose surface.

U.S. Pat. No. 3,762,432 discloses a pressure test plug for use with high pressure system by insertion through a resilient valve core in a threaded valve connector.

U.S. Pat. No. 4,524,811 discloses an engine oil sampling device which employs a hollow needle to access oil in the engine through a centrally bored self-sealing access plug connected with a wall of the engine in communication with the oil.

The present invention is to be distinguished from the above discussed patents in that the patents do not deal with a pressure relief device for an automotive cooling system. Although U.S. Pat. No. 2,254,102 discloses a hydrometer for use with the cooling system of an internal combustion engine, the patent does not disclose any means for providing a pressure relief apparatus for a cooling system. The present invention provides such a pressure relief apparatus for pressure relief of a cooling system of an internal combustion engine which contains a hot liquid under pressure, i.e., at a pressure greater than ambient pressure.

SUMMARY OF THE INVENTION

The present invention comprises a pressure relief device for cooling systems of internal combustion engines. The pressure relief device comprises a rigid hollow tube having a sharp pointed first end for penetration of a hose of a cooling system with a hole set back from the pointed end and in communication with the hollow tube, a penetration stop means for controlling the distance said sharp pointed end will penetrate the hose and handle means for said rigid hollow tube. The pressure relief device will preferably have a hollow flexible tube attached to the second end of the rigid hollow tube opposite the pointed end for use in directing the liquid from the cooling system to external collection means.

DETAILED DESCRIPTION OF THE INVENTION

The present invention relates to a pressure relief device for cooling systems of internal combustion engines having at least one penetratable hose. The design and construction of cooling systems for internal combustion engines is well known in the art as evidence by reference to U.S. Pat. Nos. 4,899,807 and 4,176,708, incorporated by reference. The temperatures of the antifreeze/coolant in such cooling systems may be between 180° F. and about 240° F. and may be under pressure, i.e., at a pressure greater than ambient pressure, which is typically (in pounds per pounds per square inch gauge [psig]) between about one psig and about 14 psig.

The pressure relief device comprises a rigid hollow tube having two ends, one end being a sharp pointed end for penetrating a hose of a cooling system with at least one hole therein set back from the pointed end and in communication with the inside of the rigid hollow tube, a penetration stop means for controlling the distance the sharp point and holes penetrate the hose of the cooling system and handle means for said rigid hollow tube.

Figure 1:
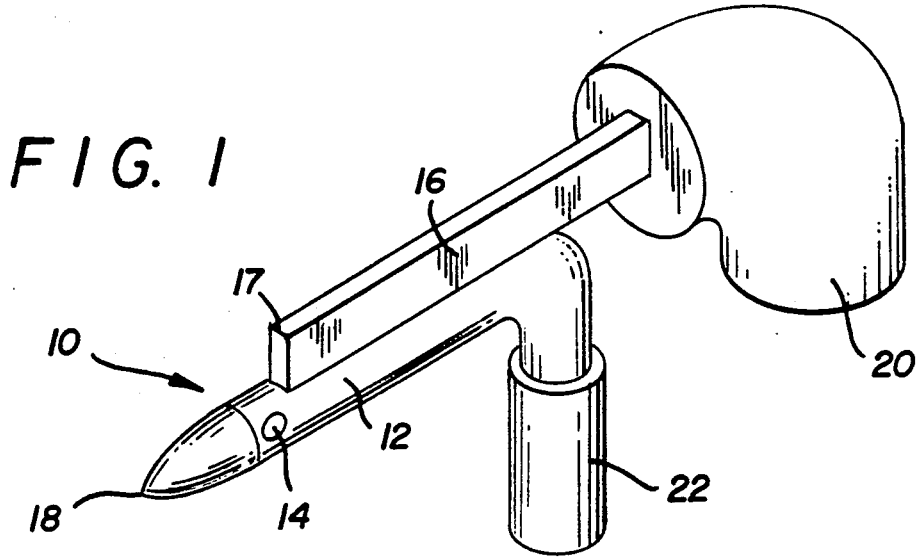
FIG. 1 is a side elevational view of the pressure relief valve.
Figure 2:
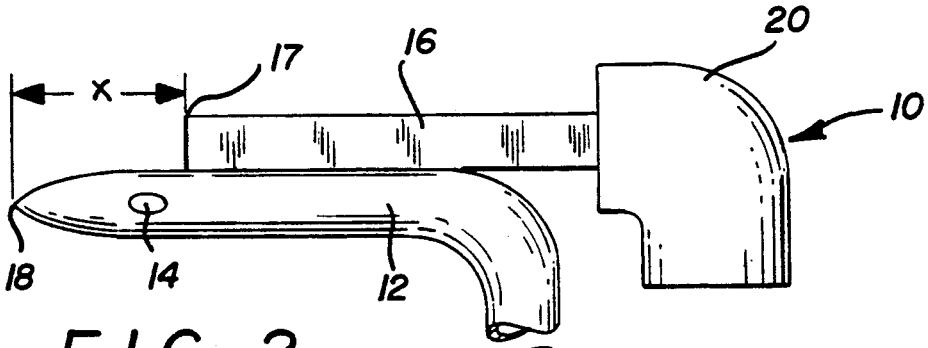
FIG. 2 is a side view of the pressure relief device showing a collection container for antifreeze/coolant from the cooling system.

Referring to FIG. 1, pressure relief device 10 is shown as rigid hollow tube 12 having pointed end 18, set back hole 14, penetration stop means 16 providing fixed penetration distance "X", handle means 20 (preferably insulated to prevent the user from touching rigid hollow tube 12 when hot), flexible tube 22 and collection means 24. During use with cooling system 40 (shown in FIG. 4) pressure relief device 10 may be employed by forcing pointed end 18 into upper radiator hose 48 until edge 17 of penetration stop means 16 abuts the outside surface of upper radiator hose 48. The distance "X" is selected in combination with the placement of hole 14 whereby pointed end 18 and hole 14 are within the interior of hose 48 of cooling system 40 when edge 17 abuts the outer surface of the hose 48 whereby the antifreeze/coolant of the cooling system may flow into hole 14 to rigid hollow tube 12. Handle means 20 is provided to prevent possible burns to the user of the pressure relief device 10, and, accordingly, is preferably insulated, since the liquid in cooling system 40 may be sufficiently heated to cause severe burns when it contacts human skin. Since it is desirable to collect any antifreeze/coolant forced from the cooling system through hole 14 into rigid hollow tube 12, flexible hollow tube 22 may be provided at the end of rigid hollow tube 12 to provide a passageway to collection means 24 for antifreeze/coolant 26, as shown in FIG. 2.

Figure 3:
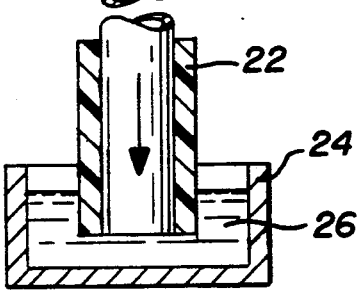
FIG. 3 is a side view of the pressure relief device showing a further embodiment.

The embodiment shown in FIG. 1 has variations which will become apparent to one skilled in the art once the present invention is understood. For example, the pressure relief device may have more than one hole 14 and the hole(s) may have a size selected to control the rate of pressure relief of the cooling system. Further, the penetration stop means and insulation handle means may be a single piece such as when a dense insulating foam which encircles rigid hollow tube 12 to provide a front edge to abut the outer surface of a hose of the cooling system and control the penetration depth while also providing an insulated surface to act as the handle means while forcing pointed end 18 is forced through the hose of the cooling system. This embodiment is shown in FIG. 3 wherein pressure relief device 10 is shown with hollow tube 32 having pointed end 34 hold 36 and handle means 38 as a means encircling hollow tube 32.

Figure 4:
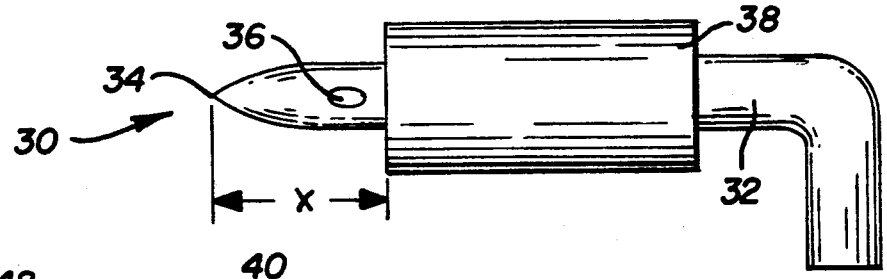
FIG. 4 is a schematic view of a cooling system of an internal combustion engine.
Figure 4:
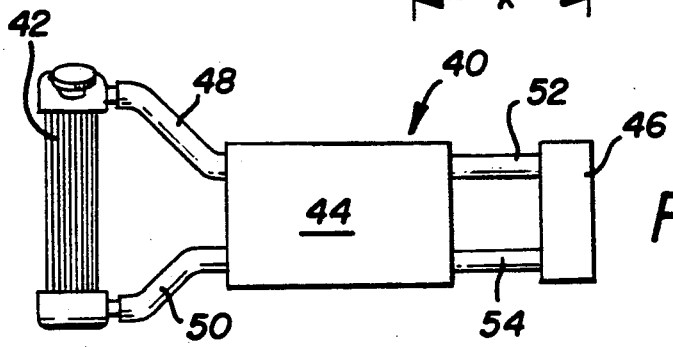

FIG. 4 shows a schematic of a cooling system 40 with which the pressure relief device of this invention may be employed. Cooling system 40 is a typical cooling system for an internal combustion engine for automobiles and trucks and is characterized by radiator 42, engine 44 and heater 46. Radiator 42 and engine 44 are connected by upper radiator hose 48 and lower radiator hose 50. Engine 44 and heater 46 are connected by upper heater hose 52 and lower heater hose 54. Such cooling systems typically employ aqueous antifreeze/coolant containing between about 30 weight percent and about 70 weight percent ethylene glycol, although the instant pressure relief device may be used to relieve the pressure of any cooling system irrespective of the chemical composition of the antifreeze/coolant under pressure in the cooling system.

The pressure relief device is constructed of materials of sufficient physical strength and thermal resistance to permit insertion of pointed end 18 into the hose of the cooling system a distance "X" while being able to withstand the elevated temperatures and chemical effects of the antifreeze/coolant. Such materials of construction are well known in the art. The use of metals such as aluminum and stainless steel and of thermoplastics having sufficiently high melting points above, e.g., nylon, polyesters, polyethylene, polypropylene, and the like, may be employed as the materials of construction of the pressure relief device.

What is claimed:

1. A pressure relief device for the cooling system of an internal combustion engine having a penetratable hose wherein said pressure relief device comprises a rigid hollow tube having a first sharp pointed end and a second end for discharge of liquid from the cooling system, at least one hole in communication with the inside of said rigid hollow tube set back from said pointed end a penetration stop means for controlling the distance said point end and hole are inserted into said hose of the cooling system and handle means for said rigid hollow tube.

2. A pressure relief device according to claim 1 wherein a flexible tube is attached to said second end for discharge of said liquid.

3. A pressure relief device according to claim 1 wherein said liquid is discharged to a collecting means.

4. A pressure relief device according to claim 2 wherein said liquid is discharged to a collecting means.

5. A pressure relief device according to claim 1 constructed of at least one of aluminum, stainless steel, polyester, polyethylene and polypropylene.

6. A pressure relief device according to claim 1 wherein said penetration stop means and said handle means are a single means.

7. A pressure relief device according to claim 1 wherein said cooling system is under a pressure of between about 1 psig and about 14 psig.

8. A pressure relief device according to claim 1 wherein said penetratable hose is the upper radiator hose.

* * * * *